US005274870A

United States Patent [19]

Stollman

[11] Patent Number: 5,274,870

[45] Date of Patent: Jan. 4, 1994

[54] MOVABLE HEAD TOOTHBRUSH APPARATUS

[76] Inventor: Harry Stollman, 648 Fathom Dr., San Mateo, Calif. 94404

[21] Appl. No.: 888,988

[22] Filed: May 26, 1992

[51] Int. Cl.[5] ..... A46B 13/08

[52] U.S. Cl. ..... 15/22.1

[58] Field of Search ..... 15/201, 202, 22.1, 22.2, 15/28

[56] References Cited

U.S. PATENT DOCUMENTS

| | | | |
|---|---|---|---|
| 1,090,126 | 3/1914 | Reichmann . | |
| 1,212,001 | 1/1917 | Baxter | 15/22.1 |
| 1,557,244 | 10/1925 | Domingue . | |
| 1,890,943 | 12/1932 | Hoffman | 15/28 |
| 2,169,581 | 10/1937 | Dadian . | |
| 2,175,975 | 5/1937 | Steiner . | |
| 2,435,394 | 2/1948 | Hawley | 15/201 |
| 2,625,697 | 1/1953 | Cyser | 15/22.1 |
| 3,677,264 | 7/1972 | Brockman . | |
| 4,079,478 | 3/1978 | Andrews, Sr. | 15/22.2 |
| 4,545,087 | 10/1985 | Nahum | 15/22.1 |
| 4,766,630 | 8/1988 | Hegemann . | |
| 4,845,795 | 7/1989 | Crawford et al. | 15/22.1 |
| 5,120,225 | 6/1992 | Amit | 15/22.1 X |
| 5,186,627 | 2/1993 | Amit et al. | 15/22.1 X |

FOREIGN PATENT DOCUMENTS

| | | | |
|---|---|---|---|
| 1112966 | 8/1961 | Fed. Rep. of Germany | 15/22.1 |
| 1805982 | 6/1969 | Fed. Rep. of Germany | 15/22.1 |
| 1321920 | 2/1963 | France | 15/22.1 |
| 622565 | 6/1961 | Italy | 15/22.1 |
| 294298 | 1/1954 | Switzerland | 15/22.1 |
| 351492 | 3/1961 | Switzerland | 15/22.1 |

*Primary Examiner*—Harvey C. Hornsby
*Assistant Examiner*—Mark Spisich
*Attorney, Agent, or Firm*—Douglas A. Chaikin

[57] ABSTRACT

Disclosed herein is a toothbrush apparatus including a tooth brush frame having a handle and a head frame, a head assembly and a retainer. The head frame has an interior opening with a gear rack. The head assembly includes a base having a plurality of openings and a bristle structure within each of the openings. The base is sized and shaped to slide within the head frame and the longitudinal edges of the base define rails. The head assembly includes a plurality of gears for compatible engagement with the gear rack. The bristle structures include static and dynamic bristles. The static bristles remain stationary, while the dynamic bristles are connected to the gears and rotate with the gears. The retainer has an interior guide for accepting the rails for sliding connection. The head assembly including the retainer are force fit within the head frame with the gears engaging the gear rack.

10 Claims, 4 Drawing Sheets

MOVABLE HEAD TOOTHBRUSH APPARATUS

BACKGROUND OF THE INVENTION

1. Field of the Invention

This invention relates to a dental apparatus, particularly a periodontal dental apparatus and more particularly to a toothbrush apparatus which has a movable head.

2. Previous Art

On a daily basis, there is no more important action one can take to preserve one's teeth than brushing. Tooth brushing cleans the teeth and prevents the build of plaque and similar tooth decaying material. Tooth brushing has been known for a very long time and there has been a variety of devices to assist one in doing a thorough job of cleaning teeth by brushing.

Earlier in this century, mechanical improvements to tooth brushes were emphasized. For example, Domingue, U.S. Pat. No. 1,557,244 discloses a tooth brush having "rotary cleaning elements" (bristles). Reichmann, U.S. Pat. No. 1,090,126 and Steiner U.S. Pat. No. 2,175,975 also discloses tooth brushes having rotating cleaning elements. Each of these devices is designed to improve the tooth brush's ability to clean the teeth and remove foreign matter such as plaque and the like.

Dadian, U.S. Pat. No. 2,169,581, discloses an additional mechanical improvement to a tooth brush. Dadian discloses a tooth brush having a pivotable head.

More recent tooth brush apparatus improvements have focused on increased cleaning ability by automatic means. For example, Crawford et al, U.S. Pat. No. 4,845,795 discloses a periodontal cleaning device having a plurality of rotating heads and gears powered by automatic means. Hegemann, U.S. Pat. No. 4,766,630 and Brockman, U.S. Pat. No. 3,677,264 similarly disclose automatic periodontal cleaning devices which use an automatic method for rotating the cleaning element for improving tooth cleaning.

While the automatic periodontal cleaning devices have proven effective at cleaning, they tend to be somewhat bulky and therefore difficult to carry while traveling and the like. Additionally, some of the automatic periodontal devices require some training before they can be used effectively. Also, these automatic devices are many times more expensive than a simple tooth brush.

What is needed is simple toothbrush apparatus that has the effectiveness of the automatic periodontal devices and the cost and convenience of the simpler mechanical devices.

SUMMARY OF THE INVENTION

It is an object of this invention to provide a toothbrush apparatus that is effective and simple to use.

It is a further object of this invention to provide such a toothbrush apparatus that includes a head having rotating bristles.

It is a further object of this invention to provide such a toothbrush apparatus that has both rotating bristles and static bristles.

In accordance with the above objects and those that will be mentioned and will become apparent below, the toothbrush apparatus in accordance with this invention comprises:

the head frame having an interior opening;

a head assembly, the head assembly being sized and shaped to slide within the head frame, the head assembly including;

a base having longitudinal edges defining rails, bristle means suitable for cleaning teeth, connected to the base; and retaining means for retaining the head assembly within the head frame, the retaining means having an interior guide for sliding connection with the rails;

whereby, when the head assembly is connected to the tooth brush head frame and is retained by the retaining means, and the head assembly may slide within the head frame.

In a preferred embodiment of the invention, the toothbrush apparatus in accordance with this invention, comprises:

the head assembly frame having an interior opening and a gear rack within the interior opening;

a head assembly, the head assembly being sized and shaped to fit compatibly within the head frame, so as to allow the head assembly to be able to move within the head frame, the head assembly including;

a base, gear means for compatibly engaging the gear rack and allowing the head assembly to move within the head frame while engaging the gear rack, the gear means having a plurality of gears, bristle means suitable for cleaning teeth, connected to the base, the bristle means include a plurality of static bristles and at least one dynamic bristle, the static bristles connected to the base, while each of the dynamic bristles are connected to a gear which rotates in response to the movement of the head assembly; and retaining means for retaining the head assembly within the head frame, whereby, when the head assembly is connected to the tooth brush head frame and is moved the dynamic bristles rotates in response to such movement.

In a further preferred embodiment of the above toothbrush apparatus, the base includes a plurality of rollers to assist the head assembly in sliding within the guide.

It is an advantage of this invention to provide a toothbrush apparatus having the advantages of automatic periodontal devices and the cost and convenience of mechanical tooth brushes.

It is an additional advantage of this invention to provide a toothbrush apparatus which effectively cleans teeth without having to adapt a new method of tooth cleaning.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
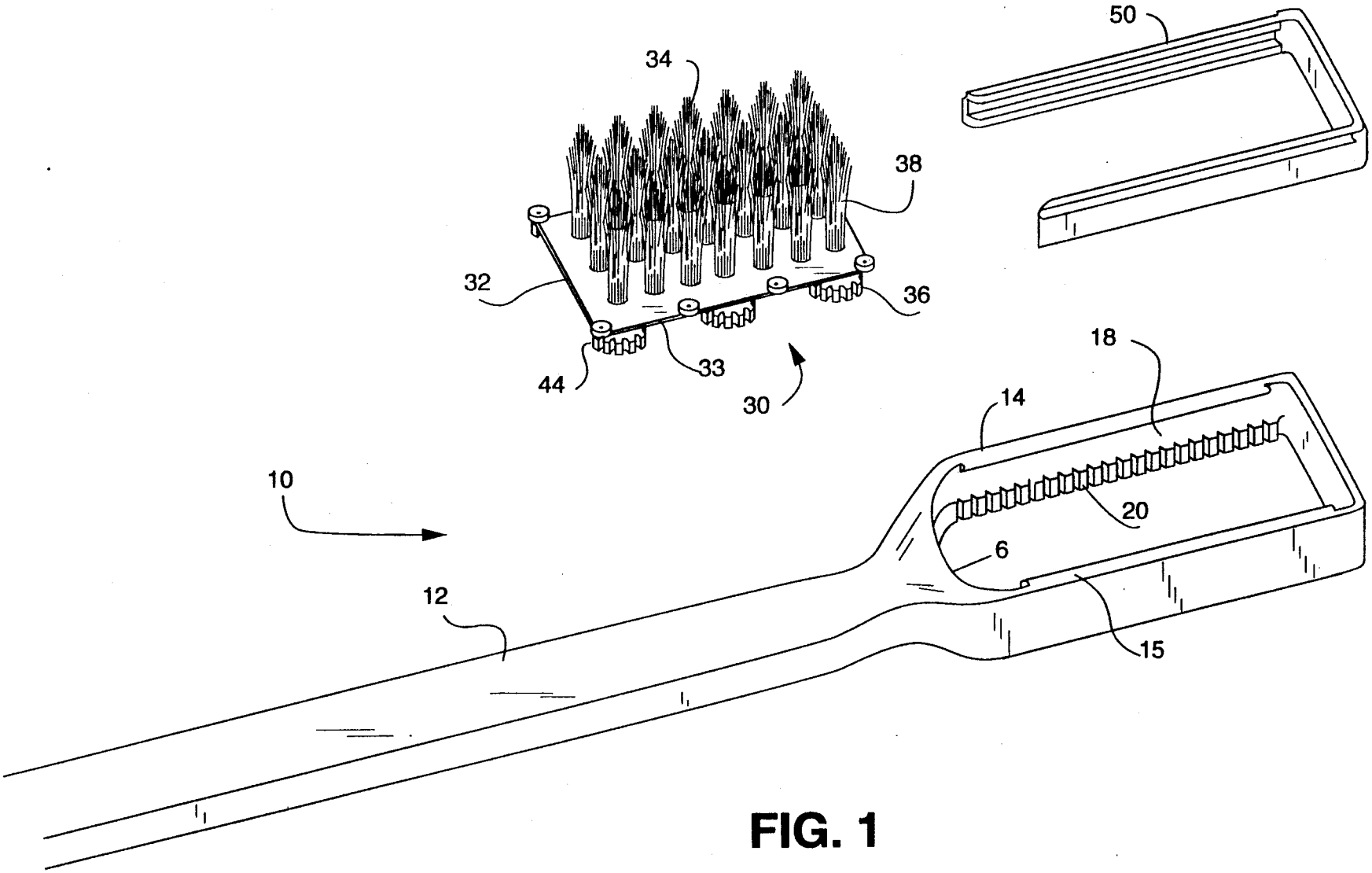
FIG. 1 is exploded plan view of the toothbrush apparatus in accordance with this invention.
Figure 2:
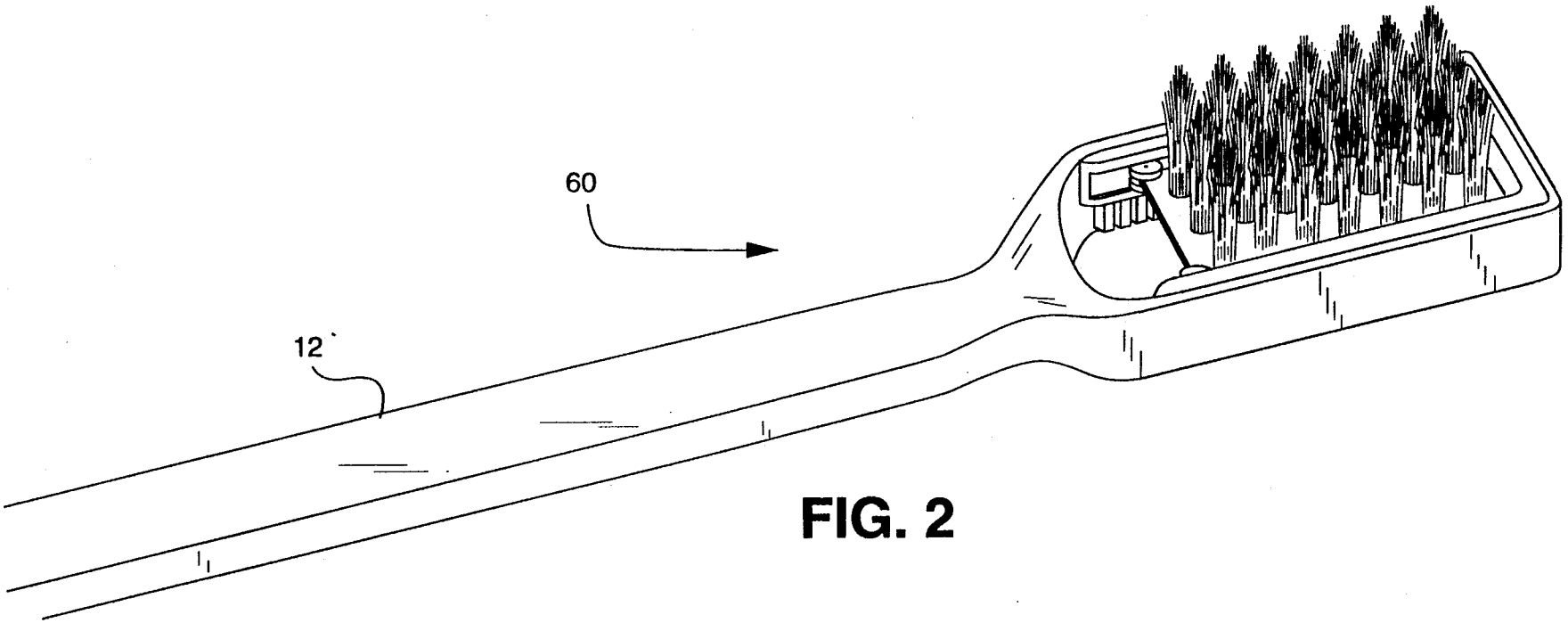
FIG. 2 is an elevated perspective plan view of an alternate embodiment of the toothbrush apparatus in accordance with this invention.
Figure 3:
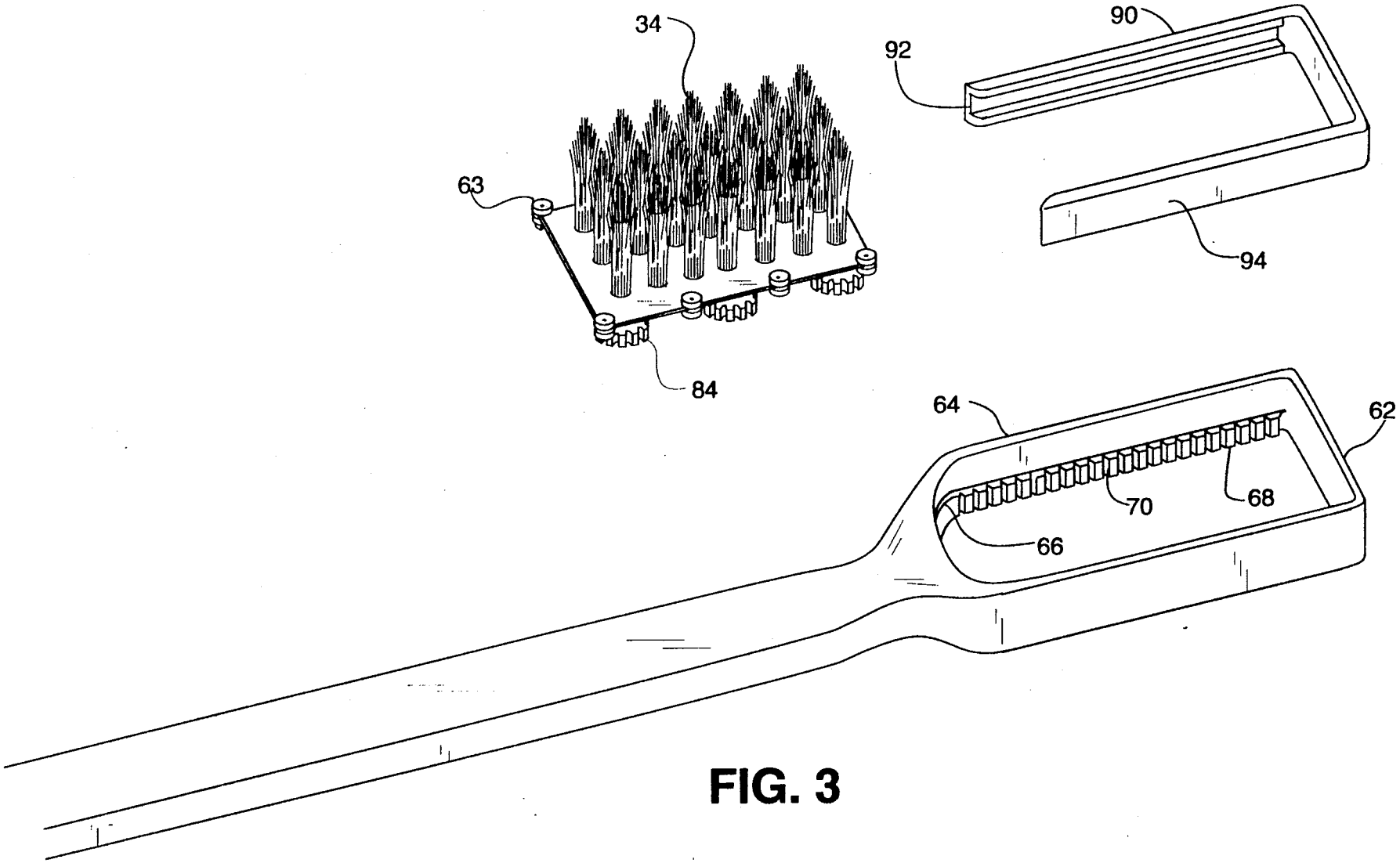
FIG. 3 is an exploded view of the alternate embodiment of the toothbrush apparatus in accordance with this invention.
Figure 4:
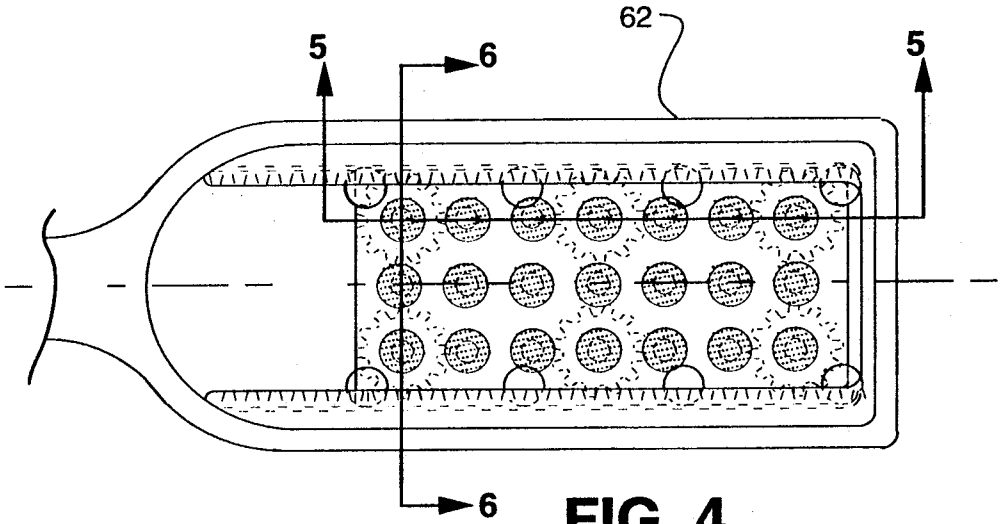
FIG. 4 is a top plan view of the toothbrush apparatus of FIG. 2.

The invention will now be described with respect to FIG. 1 which illustrates the toothbrush apparatus, generally denoted by the numeral 10. The toothbrush apparatus 10 includes a handle 12 on one end of the toothbrush apparatus 10 and a head frame 14 on the other end of the toothbrush apparatus 10.

The head frame 14 has an interior opening 16. The interior opening 16 has a pair of sides 18 having a gear rack 20 thereon. In the preferred embodiment shown in FIG. 1 the toothbrush handle 12 and head frame 14 are molded in one pieced. Further, the gear rack 20 is also molded into the head frame 14 with the handle 12 and head frame 14 molded as one piece.

The toothbrush apparatus 10 includes a head assembly, generally denoted by the numeral 30. The head assembly 30 includes a base 32 and a plurality of bristle structures 34.

The base 32 has side edges defining rails 33, which as will be appreciated more fully hereinafter, enable the head assembly 30 to slide within the head frame 14. Additionally, the base 32 has a plurality of openings sized and shaped to accommodate the bristle structures 34. As will be appreciated more fully hereinafter, there are two kinds of bristle structures 34, those that rotate with the movement of the head assembly defining dynamic bristles and those that are fixed defining static bristles.

The head assembly 30 additionally includes gears 36 having a center opening. The dynamic bristles 38 have bristle at one end and a foot 40 at the other end (shown clearly in FIGS. 5 and 6). The foot 40 comprises a sleeve 42 which surrounds and holds the bristles. The bristles are sized and shaped to fit snugly into the sleeve 42. The sleeve 42 is sized and shaped to fit snugly into the opening in the gear 36.

The gear 36 is connected to the base 32 by threading the foot 40 through the base openings and snugly connecting the sleeve 42 to the opening in the gear 36. The connection between the foot 40 and the gear 36 is such that when the gear 36 rotates the dynamic bristle structure also rotates.

The head assembly 30 includes a plurality of rollers 44 adjacent the gears 36. As will be more fully appreciated hereinafter, the rollers 44 assist the head assembly 30 to slide within the head frame 14.

The toothbrush apparatus 10 includes a retainer 50 for retaining the head assembly 30 within the head frame 14. The retainer 50 is sized and shaped to fit within the head frame 14 via a force fit. The head frame 14 has a locking lip 15. The retainer 50 is designed for a mating fit with the head frame 14. The locking lip 15 locks the retainer in place, once the retainer 50 is force fit to the head frame 14.

Additionally, the retainer 50 has a groove on the sides of the retainer 50 defining a guide 54 for the rails 33 of the head assembly 30. When the head assembly 30 is connected to the head frame 14 and retained in the head frame 14 by the retainer 50, it will appreciated that the base 32 is sized and shaped to slide back and forth on its rails 33 and the retainer guide 54.

In use, toothbrush apparatus 10 is used as a conventional toothbrush. When the bristle structures 34 are used to clean the teeth friction is created between the head assembly 30 and the teeth. This friction causes the head assembly 30 to slide within the head frame 14 as the toothbrush apparatus 10 is moved against the teeth. The sliding motion of head assembly 30 causes the gears 36 to rotate via the gear rack 20. As explained above, the rotating of the gears 36 causes the rotation of the dynamic bristles for additional and thorough cleaning of the teeth.

The second embodiment of the toothbrush apparatus is described with respect to FIGS. 2-6 and is generally denoted by the numeral 60. The toothbrush apparatus 60 includes the handle 12 and a head frame 62.

The head frame 62 has side members 64 on opposite sides of the head frame 62. The side members 64 have an inside ledge 66 extending into the opening defined by the head frame 62. The ledge 66 has a plurality of spaced apart teeth 68 defining a gear rack 70 which functions in a manner equivalent to the toothbrush apparatus 10.

The toothbrush apparatus 60 additionally includes a head assembly, generally indicated by the numeral 80. The head assembly 80 includes bristle structures 34, gears 84 and rollers 63. The gears 84 are virtually identical to the gears 36, except that the gears 84 are larger to accommodate the larger teeth 68 of the gear rack 70.

Similar to the toothbrush apparatus 10, the toothbrush apparatus 60 includes a retainer 90. In all respects, except for those noted below, the retainer 90 is identical to retainer 50. The retainer 90 has a guide 92, which when force fit to the head frame 62, rests upon the ledge 66.

The retainer has exterior side walls 94. In the preferred embodiment shown in FIGS. 2-6, the exterior side walls 94 are flat to match the interior of the head frame 62 and to improve the contact surface between the head frame 62 and the side walls 94. Consequently, the force fit of the head assembly 80 to the head frame 62 is strengthened.

While the head frame 62 is virtually the same as the head frame 14, it will be clearly seen that the head frame 62 does not have the locking lip 15. The flat surfaces of the side walls 94 and the interior of the head frame 62, plus the addition of the ledge 66 allow the elimination of the locking lip 15 while providing friction for a sufficient force fit.

Figure 6:
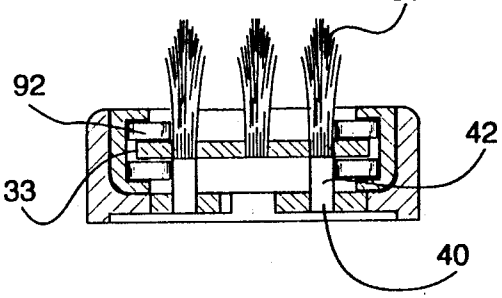
FIG. 6 is a cross-sectional plan view of the toothbrush apparatus of FIG. 2, taken along line 6—6 of FIG. 4, shown in the direction of the arrows.
Figure 5:
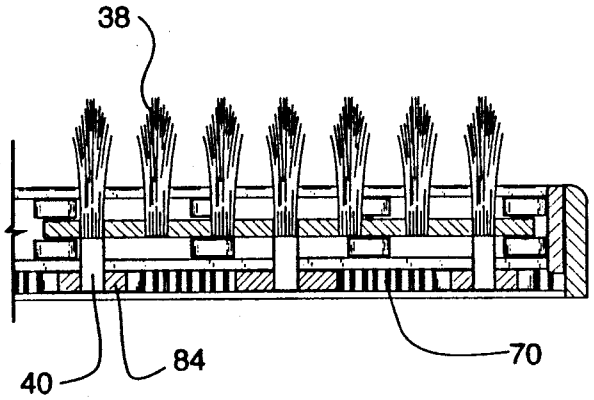
FIG. 5 is a cross-sectional plan view of the toothbrush apparatus of FIG. 2, taken along line 5—5 of FIG. 4, shown in the direction of the arrows.

FIGS. 5 and 6 show the "length" and "width" cross sections of the toothbrush apparatus 60, respectively. As seen with respect to FIG. 5, the foot 40 of the dynamic bristle 38 comprising the sleeve 42 connects the gear 84 to the base 32 as described above. As will be appreciated from FIG. 5, the sides of the base 32 defining rails 33 are smaller in length than the length of the head frame 62. This allows the base 32 to slide within the head frame 62 as described above with respect to toothbrush apparatus 10.

With respect to FIG. 6, it can be clearly seen that the toothbrush apparatus 60 includes rollers 63 which are connected to the rails 33 as in the earlier described embodiment. Likewise, the rollers 63 assist the rails 33 in sliding within the guide 92. As can be seen from the drawing, the rollers 63 are larger than the rollers 44. This additionally assists the elimination of the locking lip 15 from the second embodiment, the toothbrush apparatus 60.

In use, the toothbrush apparatus 60 works in an identical manner to the first embodiment, the toothbrush apparatus 10.

While the foregoing detailed description has described several embodiments of the toothbrush apparatus in accordance with this invention, it is to be understood that the above description is illustrative only and not limiting of the disclosed invention. Particularly, the use of rollers and their relative size is in no way limiting of the inventive concept herein. Additionally, it will be appreciated that the toothbrush apparatus may also function without gears and a gear rack, using only the rails and guide to obtain the sliding motion of the head assembly. It will be appreciated that the toothbrush apparatus without either rollers or gears will work within the scope and spirit of this invention. Thus, the invention is to be limited only by the claims as set forth below.

What is claimed is:

1. A movable head toothbrush apparatus, including a toothbrush having a handle and a head frame, comprising:

the head frame having an interior opening and a gear rack within the interior opening;

a head assembly being adapted for compatibly sliding within the interior opening of the head frame head assembly including a base and bristle means suitable for cleaning teeth connected to the base, the bristle means comprising static bristle members fixed with respect to said base and a plurality of dynamic bristle members mounted for movement relative to said base, each of bristle members having a distal end spaced from said base and a proximal end which defines a foot;

gear means including a plurality of gears, each foot of the dynamic bristle members is connected to a respective one of the gears, the remaining bristle members defining the static bristles, the gear means compatibly engages the gear rack while the head assembly moves slidably within the interior opening of the head frame; and retaining means operatively engaging the head frame and said base for retaining the head assembly within the head frame, whereby, when the head assembly is slidably connected to the head frame and is retained by the retaining means, the gears of the gear means engage the gear rack of the head frame and allow the head assembly to move slidably with respect to the head frame while rotating the dynamic bristles.

2. A movable head toothbrush apparatus, including a toothbrush having a handle and a head frame, comprising:

the head frame having an interior opening and a gear rack within the interior opening.

a head assembly, the head assembly being sized and shaped to fit compatibly within the interior opening of the frame, so as to allow the head assembly to be able to move within the interior opening the head assembly including:

a base, gear means, for compatibly engaging the gear rack and allowing the head assembly to move within the interior opening while engaging the gear rack, the gear means includes at least one gear, bristle means suitable for cleaning teeth connected to the base, the bristle means include a plurality of static bristles and at least one dynamic bristle, the static bristles being fixedly connected to the base, said at least one dynamic bristle is connected to a respective gear of said gear means which rotates in response to the movement of the head assembly; and retaining means operatively engaging the head frame and said base for retaining the head assembly within the head frame, whereby, when the head assembly is connected to the tooth brush head frame and is moved, said at least one dynamic bristle rotates in response to such movement.

3. A toothbrush apparatus as set forth in claim 2, wherein the head frame includes a locking means defining a lip for locking the retaining means within the head frame and wherein the retaining means has a detente for compatible engagement of the locking lip.

4. A toothbrush apparatus as set forth in claim 2, wherein the retaining means is connected to the head frame via force fit.

5. A movable head toothbrush apparatus, including a toothbrush having a handle and a head frame, comprising:

the head frame having an interior opening and a gear rack within the interior opening;

a head assembly, the head assembly being adapted to slidably fit within the interior opening of the head frame, the head assembly including:

a base having side edges defining rails, gear means including at least one gear for compatibly engaging the gear rack and allowing the head assembly to move within the head frame while engaging the gear rack, bristle means suitable for cleaning teeth, connected to the base, the bristle means include a plurality of static bristles and at least one dynamic bristle, the static bristles being fixedly connected to the base and said at least one dynamic bristle connected to a respective gear of said gear means and retaining means engaging the head frame for retaining the head assembly within the head frame, the retaining means having sides defining guide means for compatibly accepting the base rails, so that the base rails may slide back and forth within the guides as the head assembly moves, whereby, when the head assembly is slidably connected to the head frame and when the head assembly is moved with respect to the head frame, the head assembly slides within the head frame on the guide means and the gear means turns said at least one dynamic bristle.

6. A toothbrush apparatus as set forth in claim 5, wherein the head assembly includes rollers connected to the base and wherein the guides means is sized and shaped for compatible acceptance of the rollers.

7. A toothbrush apparatus as set forth in claim 5, wherein the head assembly includes at least one pair of side by side dynamic bristles.

8. A toothbrush apparatus as set forth in claim 5, wherein the head assembly includes at least two pairs of side by side dynamic bristles.

9. A toothbrush apparatus as set forth in claim 5, wherein the head assembly includes at least three pairs of side by side dynamic bristles.

10. A toothbrush apparatus as set forth in claim 5, wherein the gear means includes a plurality of gears.

* * * * *